US005551106A

United States Patent [19]

Schacht et al.

[11] Patent Number: 5,551,106

[45] Date of Patent: Sep. 3, 1996

[54] PORTABLE FOLDABLE RECREATIONAL ENCLOSURE

[76] Inventors: Laurie A. Schacht, 952 Gertmin Rd., Woodmere, N.Y. 11598; Laura Karson, 1291 Seawane Dr., Hewlett Harbor, N.Y. 11557

[21] Appl. No.: 320,698

[22] Filed: Oct. 11, 1994

[51] Int. Cl.[6] ..... A47C 7/00

[52] U.S. Cl. ..... 5/99.1

[58] Field of Search ..... 119/165, 167, 119/170; 5/99.1

[56] References Cited

U.S. PATENT DOCUMENTS

| | | | |
|---|---|---|---|
| 3,684,155 | 8/1972 | Smith | 119/170 |
| 4,279,217 | 7/1981 | Behringer | 119/170 |
| 4,698,862 | 10/1987 | Mairs | 5/99.1 |
| 4,869,204 | 9/1989 | Yananton | 119/170 |
| 4,870,924 | 10/1989 | Wolfe | 119/167 |
| 4,967,432 | 11/1990 | Kujawski et al. | 5/99.1 |
| 4,999,863 | 3/1991 | Kane | 5/99.1 |
| 5,115,524 | 5/1992 | Antosko | 5/99.1 |
| 5,144,914 | 9/1992 | Giannakopoulos | 119/168 |
| 5,228,154 | 7/1993 | Brevi et al. | 5/99.1 |

*Primary Examiner*—Michael J. Milano
*Attorney, Agent, or Firm*—Michael I. Kroll

[57] ABSTRACT

A portable foldable recreational enclosure comprising a pen large enough to hold at least one child therein. A disposable liner fits into the pen, so that the child can make a mess when playing, allowing the liner to be removed and discarded later.

1 Claim, 2 Drawing Sheets

PORTABLE FOLDABLE RECREATIONAL ENCLOSURE

BACKGROUND OF THE INVENTION

1. Field of the Invention

The instant invention relates generally to activity devices and more specifically it relates to a portable foldable recreational enclosure.

2. Description of the Prior Art

Numerous activity devices have been provided in prior art. For example U.S. Pat. Nos. 3,777,321 to Hargette; 3,924,280 to Vaiano; 4,371,995 to Donhauser and 4,901,998 to Griffith all are illustrative of such prior art. While these units may be suitable for the particular purpose to which they address, they would not be as suitable for the purposes of the present invention as heretofore described.

HARGETTE, LAWRENCE W.

PORTABLE COLLAPSIBLE PLAYPEN

U.S. Patent No. 3,777,321

A playpen which in a preferred embodiment is inclusive of a bottom cushion as a part of each of upwardly foldable floor segments pivotable from adjacent fence elements attached in series to other consecutive similar sections. The last section is joinable with the first section of the series and with the upwardly foldable floor segments. When downwardly mounted it is joinable with adjacent other floor sections preventable of upward movement of any one or more of the floor sections when in a closed-fence state. The playpen is collapsible foldable in an accordion-like fashion resulting from intermediate hinge elements between alternate ones of the several sections of the series.

VAIANO, VINCENT

PORTABLE PLAYPEN

U.S. Pat. No. 3,924,280

A foldable, portable playpen comprising a floor of a plurality of hinged triangular foldable sections. Vertically erectable posts are hingedly secured to the floor's corners. The walls of the playpen are formed of a netting of sturdy material secured to the posts and the floor edges. Bumpers are secured between the top portions of the posts and top edges of the netting.

DONHAUSER, WILLIAM H.

RECREATIONAL BASIN

U.S. Pat. No. 4,371,995

A recreational basin having a tub with an inlet for fluids thereto. A pan is superposed in relation to the tub such that fluids can drain from the pan into the tub. A pump transfers fluid from the tub to the pan, while a screening device prevents solids from moving from the pan to the tub. A regulator maintains a desired level of fluid in the tub.

GRIFFITH, BETTY L.

MULTI-FUNCTIONAL ACTIVITY TABLE

U.S. Pat. No. 4,901,998

A multi-functional activity table to be used as a play/learning tool for children of all ages. The apparatus comprises three main components including a table top, pedestal and domed base, each of which can be employed separately or in combination with one or more of the others for a child's amusement and instruction. The apparatus is easily converted into the following: art table, water table, sandbox, rocker, toss game, crawl through and tee ball toy. The apparatus not only represents a substantial saving in cost over that which would be required to acquire an individual toy for each activity, but also has nesting features which allow one to store the apparatus in much less space than would be possible with equipment designed only for each individual game. Furthermore, the multi-functional activity table offers many attractive features not available with a single game-type apparatus. In particular, children themselves derive much pleasure from transforming the apparatus as they play with it, in first one activity and then another.

SUMMARY OF THE INVENTION

A primary object of the present invention is to provide a portable foldable utility pen that will overcome the shortcomings of the prior art devices.

Another object is to provide a portable foldable recreational enclosure with a disposable liner which lines a pen, so that children can make a mess therein when playing, allowing the liner to be removed and discarded later.

An additional object is to provide a portable foldable recreational enclosure which is lightweight and can be placed in a folded position for storage when not being used.

A still additional object is to provide a portable foldable recreational enclosure, whereby children can get into and out of the pen without assistance.

A further object is to provide a portable foldable recreational enclosure that is easy to unfold, set up and fold up again.

A still further object is to provide a portable foldable recreational enclosure that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
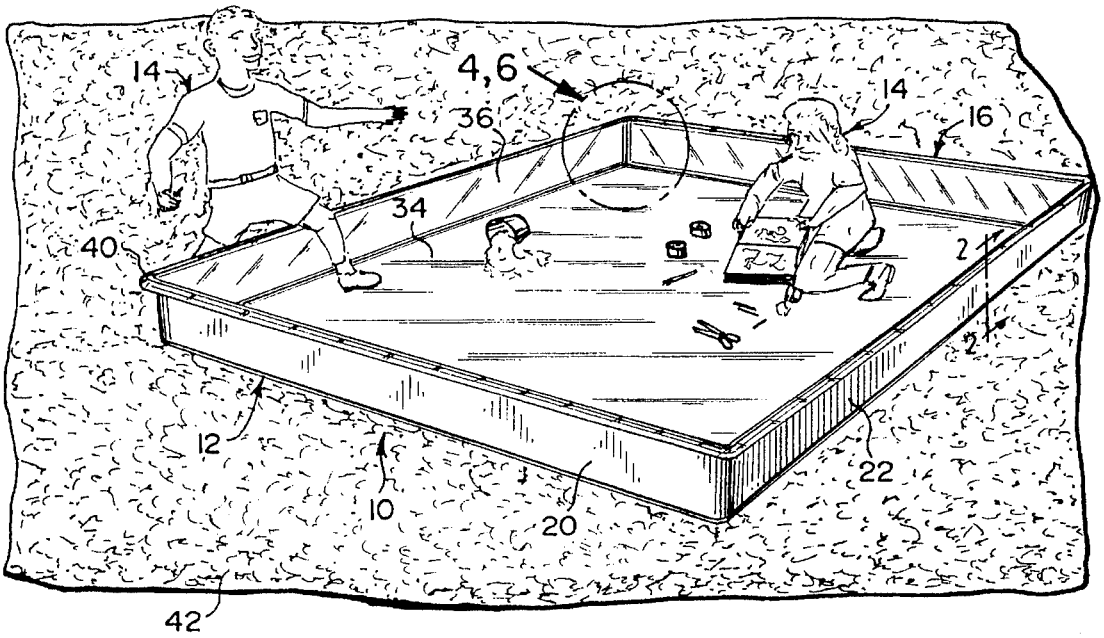
FIG. 1 is a perspective view of the instant invention in its unfolded position in use.
Figure 2:
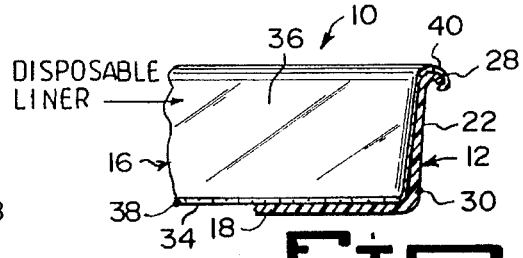
FIG. 2 is a cross sectional view of a portion thereof taken along line 2—2 in FIG. 1.

Turning now descriptively to the drawings, in which similar reference characters denote similar elements throughout the several views, FIGS. 1 through 6 illustrate a portable foldable recreational enclosure 10 comprising a pen 12 large enough to hold at least one child 14 therein. A disposable liner 16 fits into the pen 12, so that the child 14 can make a mess when playing, allowing the liner 16 to be removed and discarded later.

The pen 12 includes a floor 18. A pair of opposite end walls 20 extend upwardly from the floor 18. A pair of opposite side walls 22 extend upwardly from the floor 18, thereby forming a compartment 24 with an open top 26, so that the liner 16 can be inserted within the compartment 24 of the pen 12.

The pen 12 further includes a rolled lip 28 on the upper edges of the end walls 20 and the side walls 22. The rolled lip 28 will help to retain the liner 16 within the compartment 24 and at the same time will make the upper edges of the end walls 20 and the side walls 22 safe for the child 14 when entering and exiting the pen 12.

Figure 3:
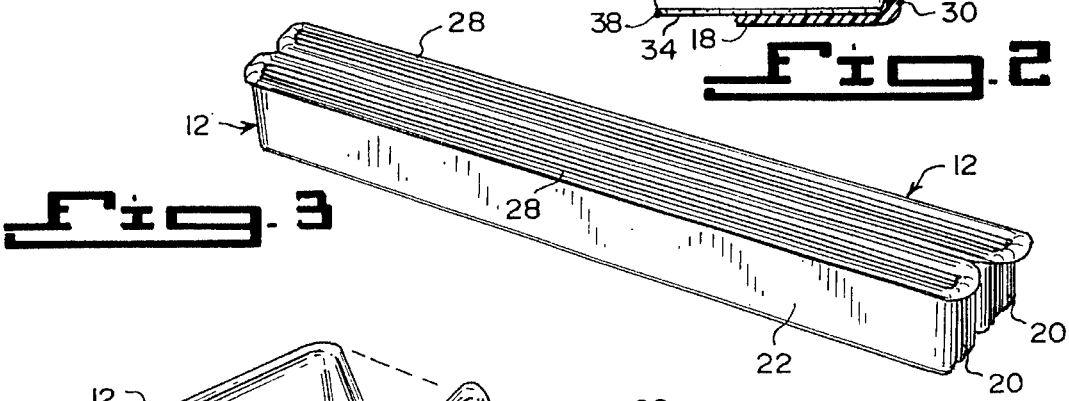
FIG. 3 is a perspective view of two pens in a folded position and placed together for storage.
Figure 4:
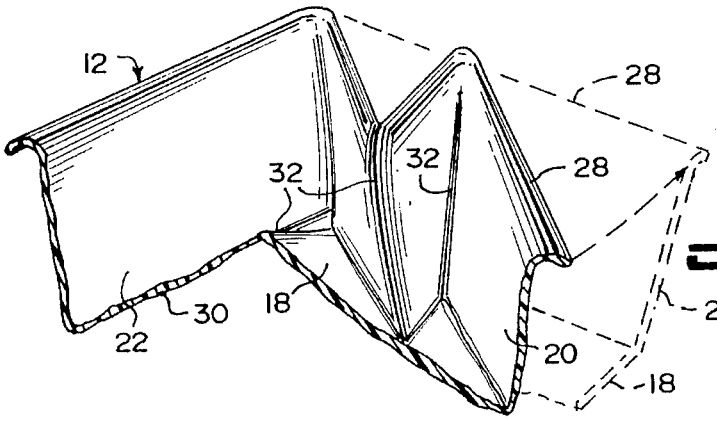
FIG. 4 is an enlarged perspective view of a corner of the pen as indicated by arrow 4 in FIG. 1, showing the accordion bellows fold lines of one end wall going into its folded position.
Figure 5:
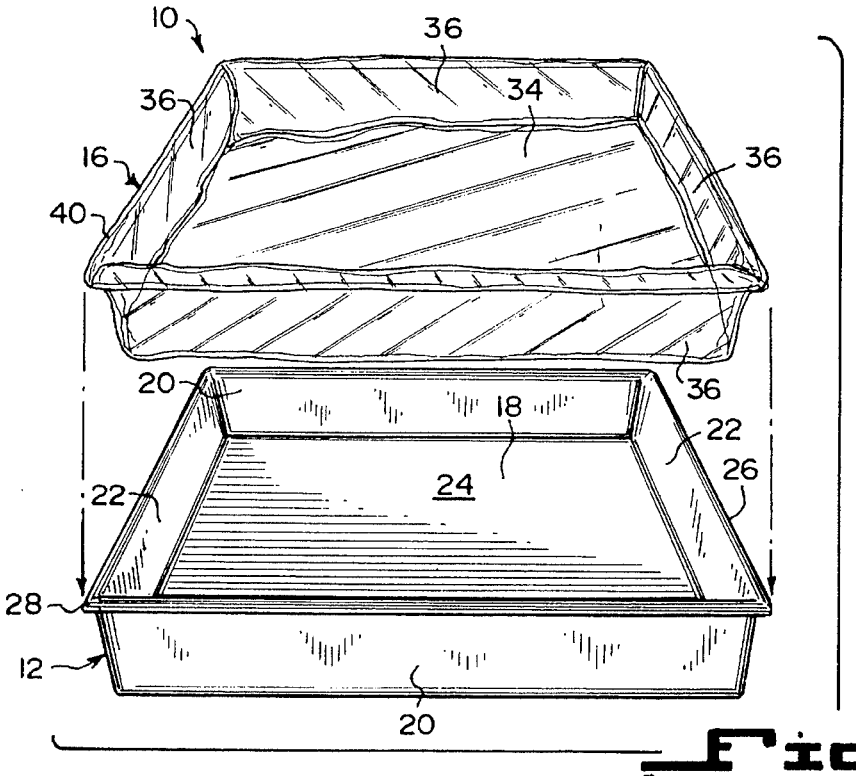
FIG. 5 is an exploded perspective view showing the liner ready to be put into the pen.
Figure 6:
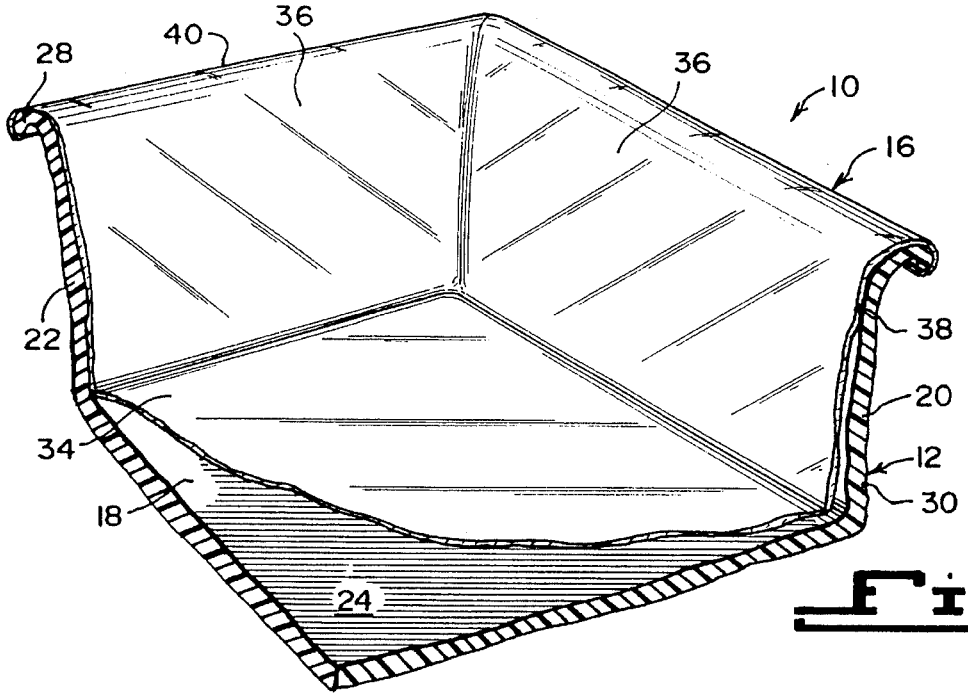
FIG. 6 is an enlarged perspective view of the corner of the pen and the liner together in greater detail as indicated by arrow 6 in FIG. 1.

The pen 12 is fabricated out of a semi-rigid material 30. The semi-rigid material 30 is vinyl. As best seen in FIG. 4, the end walls 20 and the floor 18 of the pen 12 includes a plurality of accordion bellows fold lines 32. The pen 12 can be placed into a folded position for storage when not in use, as shown in FIG. 3.

The liner 16 includes a base portion 34 and four integral upstanding side portions 36. The liner 16 is sized to fit into the pen 12, while allowing the child 14 to play within the liner 16. The liner 16 is fabricated out of a flexible material 38. The flexible material 38 is a thin sheet of plastic. The outer perimeter of the line 16 includes a bent over edge 40 thereabout to engage with the rolled lip 28 on the upper edges of the end walls 20 and the side walls 22 of the pen 12.

The pen 12 of the portable foldable recreational enclosure 10 can be made in varying sizes depending upon its use, so that it can also be used by adults to paint in, make ceramics and to perform other types of work activities. Children can use the recreational enclosure 10 outdoors as well as indoors to keep a carpet 42, as shown in FIG. 1, and other kinds of surfaces clean.

OPERATION OF THE INVENTION

To use the portable foldable recreational enclosure 10, the following steps should be taken:

1. Unfold the pen 12 and place it upon a surface, such as a carpet 42 in FIG. 1.
2. Insert the disposable liner 16 into the compartment 24 of the pen 12, so that the base portion 34 is on the floor 18 and the upstanding side portions 36 are against the end walls 20 and side walls 22.
3. Place the bent over edge 40 of the liner 16 over the rolled lip 28 of the pen 12.
4. Allow the child 14 to now enter the pen 12 and make a mess while playing.
5. Remove the liner 16 after the child 14 is finished playing.
6. Dispose the liner 16 in a safe manner, so as to prevent any debris from going onto the carpet 42.
7. Fold up the pen 12 and store it to be used again.

LIST OF REFERENCE NUMBERS

10 portable foldable recreational enclosure
12 pen
14 child
16 disposable liner
18 floor of 12
20 end wall of 12
22 side wall of 12
24 compartment in 12
26 open top of 12
28 rolled lip on 20 and 22
30 semi-rigid material for 12
32 accordion bellows fold line in 20 and 18
34 base portion of 16
36 upstanding side portion of 16
38 flexible material for 16
40 bent over edge of 16
42 carpet It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable recreational enclosure comprising:

a) a pen large enough to hold at least one child therein and provide room for said child to play inside said pen, said pen made of vinyl semi-rigid material and comprising a floor, a pair of opposite end walls extending upwardly from said floor, and a pair of opposite side walls extending upwardly from said floor, said walls each including a rolled lip along the upper edge thereof, said pen forming a compartment with an open top and including folding means comprising a plurality of accordion bellows fold lines in each of said end and side walls and in said floor to permit said pen to be folded up into a compact unit for storage when not in use; and b) a disposable liner of flexible thin sheet of plastic material which fits into said pen, so that the child can make a mess when playing, allowing said liner to be removed and discarded later, said liner including a base portion and four integral upstanding side portions sized to fit into said pen, permitting said child to play within said liner, said liner having an outer perimeter with a bent over edge to engage the rolled outer lips of said walls of said pen.

* * * * *